United States Patent [19]

Prew

[11] Patent Number: 4,697,750

[45] Date of Patent: Oct. 6, 1987

[54] LIVE CENTER BIN MODIFICATION

[75] Inventor: Stanley R. Prew, Montoursville, Pa.

[73] Assignee: SWM Corporation, Windsor, Conn.

[21] Appl. No.: 772,498

[22] Filed: Sep. 4, 1985

[51] Int. Cl.[4] ..... B02C 19/22

[52] U.S. Cl. ..... 241/247; 198/670; 241/260.1; 366/300; 366/603; 414/301; 414/326

[58] Field of Search ..... 366/186, 156, 603, 266, 366/297, 300, 318, 324, 348; 414/318, 320, 300, 301, 325, 326, 321, 298, 302; 241/260.1, 30, 101.5, 101.3, 101.7, 246, 247, 248; 198/670, 601, 604, 605, 608

[56] References Cited

U.S. PATENT DOCUMENTS

| | | | |
|---|---|---|---|
| 2,236,219 | 3/1941 | Prater | 366/297 X |
| 2,707,621 | 5/1955 | Peiler | 366/300 X |
| 4,333,612 | 6/1982 | Hayashi | 241/101.3 X |
| 4,432,499 | 2/1984 | Henkensiefken et al. | 241/30 |

OTHER PUBLICATIONS

Bulk Storage Bulletin 6050 revised 2/79 "Live Center Bins for Bulky Materials".

"Sprout-Waldron Live Center Bins for Industrial/-Municipal Solid Waste" Specification Sheet No. 6051.

*Primary Examiner*—Mark Rosenbaum

*Attorney, Agent, or Firm*—William W. Habelt

[57] ABSTRACT

A storage bin for handling and discharging plug flow material uses shrouds to prevent wedging of plug flow material such as refuse derived fuel between vertical screws and the end walls of the bin. The bin is divided into two separate sections by the vertical screws. Wedging of plug flow material in both bin sections and material discharge is then stopped. The shrouds force the plug flow material into the active surface area of vertical screws and continuous discharge through an elongated discharge aperture is assured. Two horizontal screws are used to further augment material discharge beneath the elongated discharge aperture. The two horizontal screws are parallel and the bottom of vertical screws are between the two horizontal screws.

12 Claims, 3 Drawing Figures

LIVE CENTER BIN MODIFICATION

BACKGROUND OF THE INVENTION

1. Field of the Invention

The present invention deals with materials handling from a static receptacle and means to facilitate receptacle discharge using plural screw elements.

2. Description of the Prior Art

A live center bin is a large storage device having two end walls with two horizontal discharging screws between and at the bottom of the end walls, sloped side walls slanting towards a center lower discharge aperture and a row of vertical screws in this discharge aperture running along a line parallel to and between the two horizontal discharging screws which are also at the bottom of the vertical screws. A live center bin operates by keeping the product in the bin moving, or in quasi suspension, so that when the horizontal discharging screws require more product material for conveying out as discharging, it is available from the bottom of the moving mass above it. These screw augmented bins are utilized in handling material that will not discharge out of standard (having sloped side walls) bins which have no moving parts to augment the flow of product material towards a discharge opening. A typical product material might be cotton litters, stringy light-weight material like bagasse, small pieces of bamboo, wrote paper, shredded classified waste material, etc. These bins used on the above mentioned applications generally work, but problems arise in dealing with refuse derived fuel, hereinafter referred to as RDF. RDF is damp and contains a large amount of wire, glass, stringy rags, hoses, etc.

U.S. Pat. No. 4,432,499 teaches a portable grinder-mixer having both vertical and horizontal screws. A divider which cooperates with the screws provides cross mixing between the pair of adjacent bins effectively formed by the presence of the divider.

Generally, in bin nomenclature, when a product in a bin will discharge without having auxiliary devices in the bin, it is called mass flow. Products which will not discharge in a standard bin exhibit what is generally called plug flow. RDF is the shredded light fraction of industrial or municipal solid waste, and represents the classic example of plug flow.

The mass in live center bins is divided by the vertical screws into two separate plugs, each of which want to slide down the sloped side walls of the bin into the horizontal discharge screws.

As plug mass slides down the sloping sidewalls in the prior art bin structures, the descending end face of the descending plug of material is not in full contact with the total active surface of the two end vertical screws. As a result, the conveying action of the end vertical screws is neutralized by the loss of containment of plug material in the end vertical screw's conveying confinement. The plug material will then wedge between the end walls and the end vertical screws to form a cross-link of plug material between the separate plugs of material divided by the vertical screws in the bin. The lack of total end vertical screw surface activity caused plug material to cross-link between the end vertical screws and the end walls. Once the plugs are cross-linked by plug material wedging between the end walls and end vertical screws, the separate plugs of material in each side of the divided bin are held apart by this cross-link. Once the separate plugs are held apart, the plug material then begins to bridge by forming an arc of plug material in the cornering space formed upon the sloping side walls above the horizontal screws and the row of vertical screws. An arc of bridging plug material may form along the entire length in the bottom cornering space formed by the row of vertical screws and the adjacent sloped bin side wall above the horizontal screws.

When either of the masses forming the separate plugs in a bin cannot flow into the horizontal and or the vertical screws, there is in effect a solid cross-linking of the mass between the two plugs. This cross-linking will hold the two plugs apart as well as hold them up so that the plug material cannot slide into either the vertical or the horizontal screws. The resulting binding friction of the plug material will be enough to keep the plug material in an arcing bridge and cross-link to prevent it from moving into the screws augmenting discharge.

SUMMARY OF THE INVENTION

The present invention relates to apparatus for maintaining a suspension of plug flow material in a live center bin while preventing cross-linking and bridging of the plug flow material in the bin which would prevent material discharge. By confining or deflecting the plug flow material into the totally active surfaces of the end vertical screws, the plug flow material cannot cross-link over into the separate plug mass in the other side section of the bin and thereby stop mass flow. The present invention maintains a suspended plug flow of material without permitting cross-linking between the separate plugs or arc bridging over the lower discharge aperture. Therefore, whenever the horizontal discharge screws require more product for discharging material out of the bin, the material is always available from the bottom of the moving mass above the horizontal discharge screws.

BRIEF DESCRIPTION OF THE DRAWINGS

The present invention is further described in the accompanying drawings in which.

DETAILED DESCRIPTION

Figure 1:
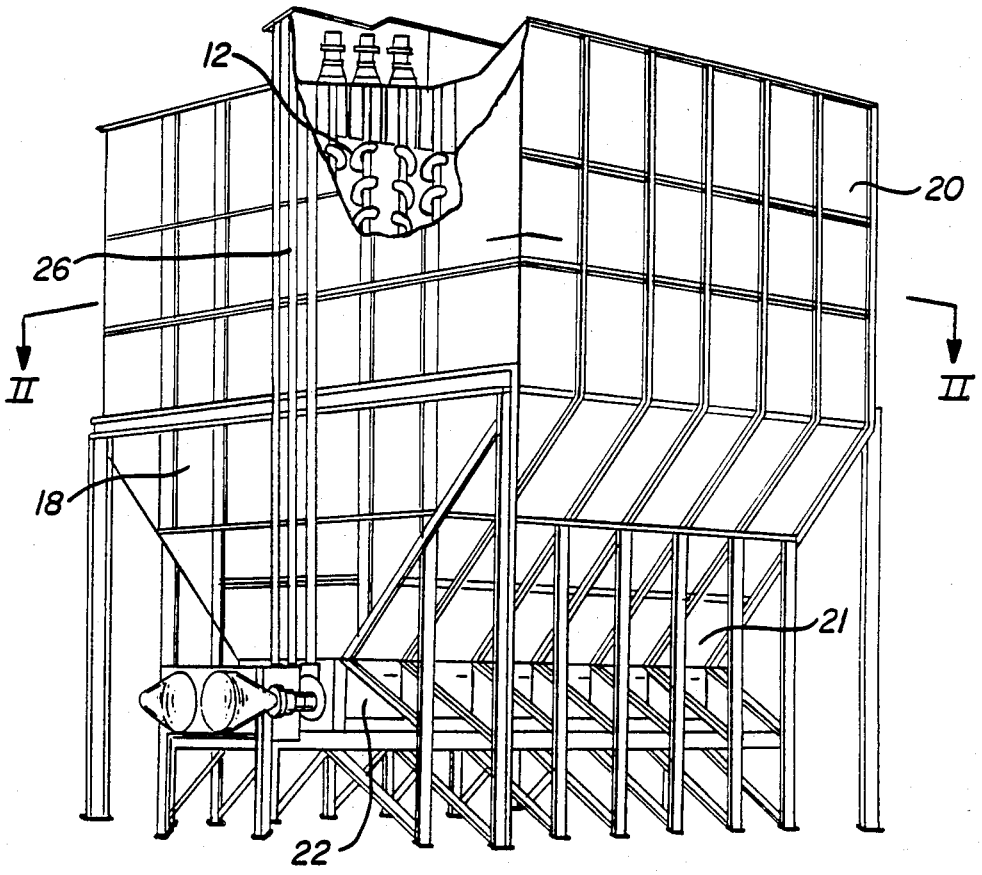
FIG. 1 is an isometric view of a live center bin with a cut away section showing the vertical screws.

In FIG. 1 the vertical screws 12 divide the bin 10 into two equal sections. The row of vertical screws 12 is perpendicular to the end walls 18 and is parallel to the side walls 20 and forms an acute angle with the sloped side walls 21 in both sections of bin 10.

Figure 2:
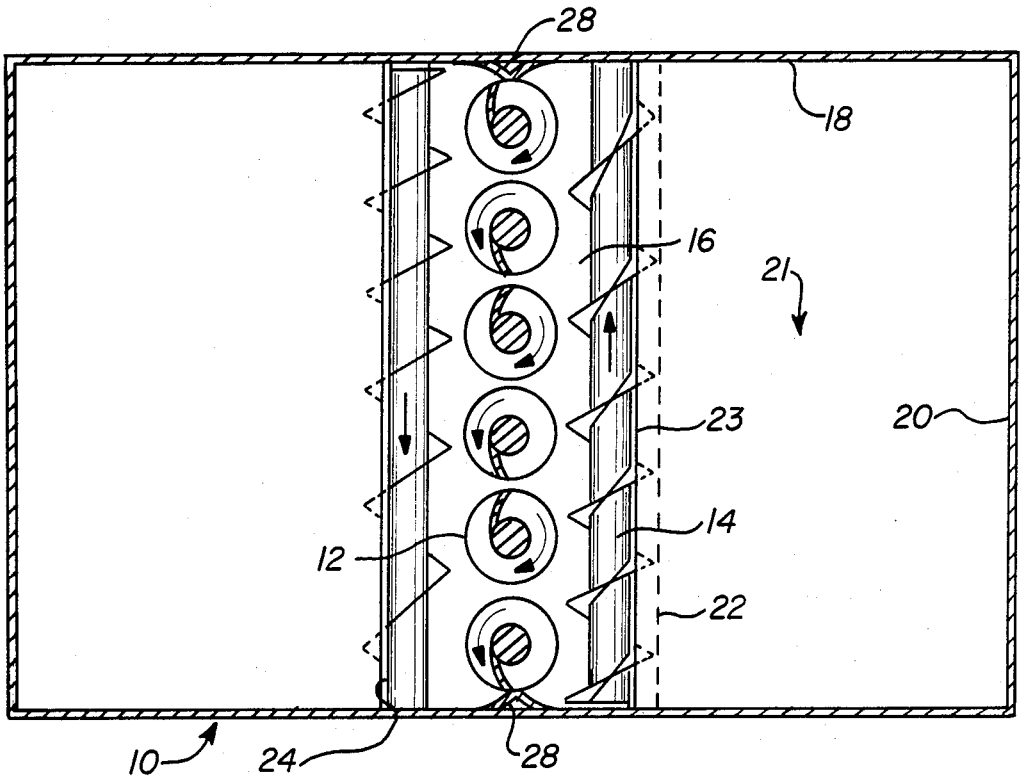
FIG. 2 is a plan view in cross-section taken through line II—II in FIG. 1 showing the deflector strip shroud embodiment of the present invention.

Referring to FIG. 2, two horizontal screws 14 run longitudinally parallel to the row of vertical screws 12 in a horizontal plane at the bottom of vertical screws 12 and in functional proximity to the vertical screws 12. The horizontal screws 14 and the bottom of the vertical screws 12 share a horizontal plane equal to the thickness of the flight diameter of the horizontal screws 14. The sides of the screws 12 at the bottom of the row are between both horizontal screws 14 and the ends of sloped wide walls 21. Sloped side walls 21 converge downwardly towards screws 14 which if extended would cut a chord line through the horizontal screws 14 above the center of the screws 14 at the angle of the sloped side walls 21.

A lower elongated aperture 16 is formed between the two converging sloped side walls 21. The sloped side walls 21 have bottom ends 23 and 24 in functional proximity above the horizontal screws 14. Sloped side walls 21 are joined on their underside near their bottom ends 23 and 24 by discharge channel 22, which encases the two horizontal screws 14 over the entire length of the sloped side walls 21 at the bottom of bin 10. The bin 10 can use the lower elongated discharge aperture 16 as a discharge outlet without a discharge channel 22 and the two horizontal discharge screws 14. However, with a discharge channel 22, the sides, ends or bottom of the discharge channel 22 or on any extension of the channel 22 beyond the end walls 18 of the bin structure 10 can be made into a discharge outlet (not shown). Deflector strips 28 are attached to end wall 18 and run vertically between end vertical screws 12 and end wall 18.

Figure 3:
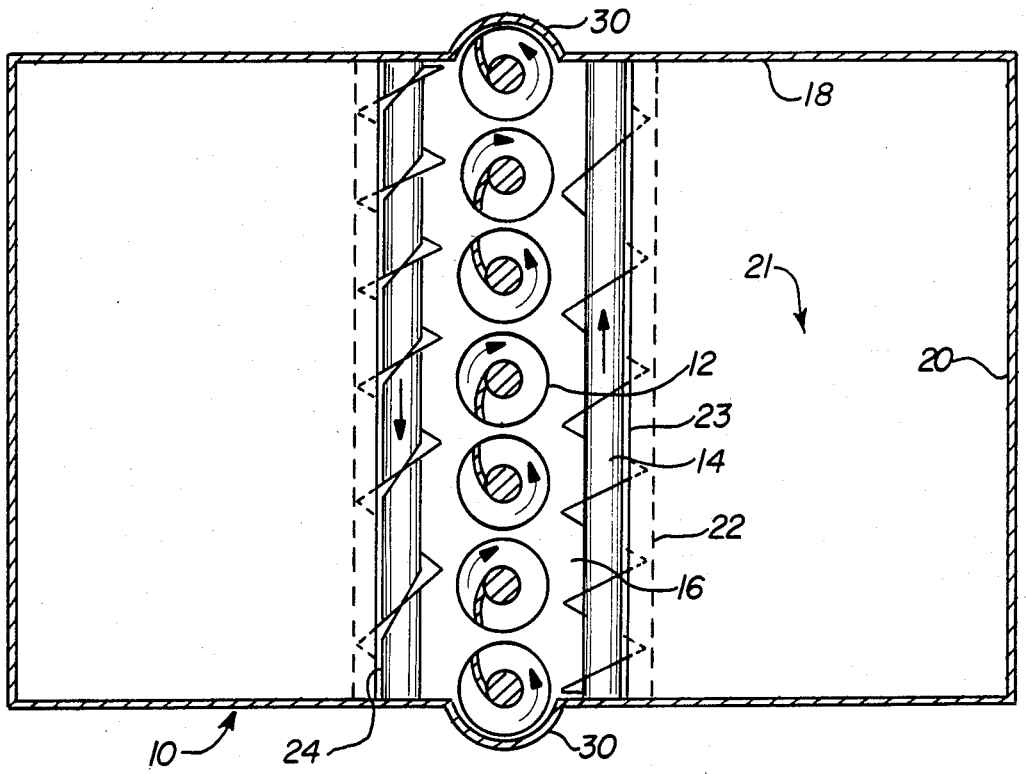
FIG. 3 is at the same location as the plan view in FIG. 2 showing another embodiment of the present invention.

As shown in FIG. 2 and FIG. 3, the two horizontal screws have counter rotation to each other so that plug material, even in the discharge channel 22, is constantly being recirculated in moving suspension with the aid of the shrouding means, i.e., the deflector strips 28 or vertical convex end wall segment 30.

Also, as shown in both FIG. 2 and FIG. 3, all the vertical screws 12 have meshing rotation with an upward conveying direction only. The screws 12 alternate in both their direction of rotation and in the negative reciprocal slope of their screw flights in order to achieve meshing rotation in the upward direction only. The screw flights are therefore alternately right and left handed in their thread or wind.

The preferred shrouding embodiment of the present invention is shown in FIG. 3 as a vertical convex end wall segment 30 in end wall 18.

In following the path of the plug flow material in suspension it can be seen that the plug material would slide downward on the sloped sidewalls 21 and the horizontal discharge screws would then remove to measured amount of plug material. Any excess plug material would be conveyed vertically upward by the vertical screws 12 to the top of each plug in both sections of bin 10. This recirculation of the excess of plug material allows each plug to be kept in flow suspension.

The product or plug flow material may be added to the top of either side section of bin 10 or one can simply run the bin out of product material before adding anything more to the bin 10. With shrouds 26 in place in the bin 10 as deflector strips 28 or as vertically convex end walls segment 30, the bin 10 can be filled from either side to overflowing and the bin 10 will still continue to discharge plug material. Without the shroud means 28 to 30, RDF plug flow material can only be added to one section of the bin 10 approximately half-way up on the slope of a sloped side wall 21 without having bridging and cross-linking of the plug flow material.

It thus will be appreciated that there has been described an apparatus that can discharge plug flow material from a bin by discharging plug flow material made available in suspended motion above an augmented discharge point without causing bridging on cross-linking of the plug material which would prevent the discharge of the plug flow material.

Although the invention has been described with a certain degree of particularly, it is to be understood that the present disclosure has been made only as an example and that the scope of the invention is defined by what is hereafter claimed.

What is claimed is:

1. An apparatus for discharging plug flow material comprising a bin having vertically opposed first and second end walls and side walls interposed between said end walls as downwardly and inwardly sloping side walls to be spaced at their lower ends to form a lower elongated discharge aperture; first and second vertical discharge screws each having a sloping screw flight and adapted for rotation about their vertical axes, said screws being positioned, respectively, adjacent said first and second end walls, the second vertical screw having a direction of rotation opposite to the direction of rotation of the first vertical screw and having a screw flight with its slope being the negative reciprocal of the slope of the screw flight of the first vertical screw whereby an upward conveyance of material is established therebetween upon rotation of the vertical screws; and first and second shroud means interposed respectively between the first vertical end wall and the first vertical screw and the second vertical screw and second vertical end wall such that wedging of the plug flow material between said vertical screws and said end walls is avoided.

2. The apparatus of claim 1 wherein the shroud means consists of first and second vertical deflector strips internally attached respectively to the first and second end walls and extending respectively toward the first and second vertical screws.

3. The apparatus as recited in claim 1 further comprising two horizontal, parallel discharge screws located below said lower elongated discharge aperture so that said vertical screws are interposed between said horizontal discharge screws.

4. The apparatus as in claim 3 wherein the spins of said horizontally parallel discharge screws are counter to each other.

5. The apparatus as in claim 3 wherein said elongated discharge aperture discharges into a discharge channel which encases said two horizontally, parallel discharge screws.

6. The apparatus as recited in claim 1 wherein said shroud is a deflector strip fixed between said end walls and said end vertical screws.

7. The apparatus as in claim 3 wherein a discharge outlet is located in an extension of said discharge channel beyond one of said end walls.

8. An apparatus for discharging plug flow material comprising:

a. opposed first and second end walls each of said end walls having a vertically convex wall segment projecting centrally from said wall;

b. side walls interposed between said end walls as downwardly and inwardly sloping side walls to be spaced at their lower ends to form a lower elongated discharge aperture; and c. a plurality of vertical discharge screws including one or more intermediate vertical screws disposed in line between first and second end vertical screws to form a row of vertical discharge screws, each of said vertical discharge screws having a sloping screw flight and adapted for rotation about their vertical axes, the rotation of said vertical discharge screws being alternately opposed in direction and the slope of the screw flights of said vertical discharge screws being alternately a negative reciprocal whereby an upwardly directed conveyance of material in established along the row of said vertical discharge screws upon rotation of said vertical discharge screws, said first and second end screws being positioned respectively in said vertically convex end wall segment projecting centrally from each of said first and second end walls such that cross-linking and bridging of the plug flow material is avoided.

9. The apparatus as recited in claim 8 further comprising two horizontal, parallel discharge screws located below said lower elongated discharge aperture so that said vertical screws are interposed between said horizontal discharge screws.

10. The apparatus of claim 9 wherein the spins of said horizontally parallel discharge screws are counter to each other.

11. The apparatus of claim 9 wherein said elongated discharge aperture discharges into a discharge channel which encases said two horizontally, parallel discharge screws.

12. The apparatus as recited in claim 8 wherein said shroud is a vertically convex wall segment projecting centrally out from each of said end walls.

* * * * *